US008460074B1

(12) United States Patent
Akers

(10) Patent No.: US 8,460,074 B1
(45) Date of Patent: Jun. 11, 2013

(54) APPARATUS AND METHOD FOR PROVIDING BREATHABLE AIR TO SAFE HAVENS WITHIN A MINE

(76) Inventor: Harold Akers, Pikeville, KY (US)

( * ) Notice: Subject to any disclaimer, the term of this patent is extended or adjusted under 35 U.S.C. 154(b) by 940 days.

(21) Appl. No.: 12/391,411

(22) Filed: Feb. 24, 2009

Related U.S. Application Data

(60) Provisional application No. 61/032,120, filed on Feb. 28, 2008.

(51) Int. Cl.
*E21F 1/00* (2006.01)

(52) U.S. Cl.
USPC ..... 454/171; 454/172

(58) Field of Classification Search
USPC ..... 454/168, 169, 170, 171, 172, 230, 454/174; 299/12
See application file for complete search history.

(56) References Cited

U.S. PATENT DOCUMENTS 1,456,808 A * 5/1923 Lowe ..... 454/169
2,069,269 A * 2/1937 Perkins ..... 62/87
2,299,793 A 6/1940 Cannady et al.
2,523,273 A * 9/1950 Blundell ..... 454/168
2,817,505 A * 12/1957 Inman ..... 454/169
3,164,079 A 1/1965 Ross
4,353,292 A * 10/1982 Almasi et al. ..... 454/168
4,707,953 A * 11/1987 Anderson et al. ..... 52/63
4,815,363 A 3/1989 Harvey
5,537,784 A * 7/1996 Baldwin ..... 52/2.17
6,457,259 B1 * 10/2002 Bilofsky et al. ..... 34/467
2006/0055193 A1 * 3/2006 Colborne ..... 296/24.3
2007/0193132 A1 8/2007 Roscioli
2007/0199244 A1 8/2007 Kennedy et al.
2007/0200420 A1 8/2007 McCormick
2007/0202796 A1 8/2007 Kennedy et al.

OTHER PUBLICATIONS

Kevin G. Stricklin, Program Information Bulletin No. 07-03, Feb. 8, 2007, Mine Safety and Health Administration, United States Department of Labor, Arlington, Virginia.

* cited by examiner

*Primary Examiner* — Steven B McAllister
*Assistant Examiner* — Brittany E Towns
(74) *Attorney, Agent, or Firm* — Wyatt, Tarrant & Combs, LLP; Matthew A. Williams

(57) ABSTRACT

Apparatus and method for providing breathable air to one or more safe havens in an underground mine from a source external to the mine utilizing a source of compressed, breathable air located outside of the underground mine.

1 Claim, 3 Drawing Sheets

APPARATUS AND METHOD FOR PROVIDING BREATHABLE AIR TO SAFE HAVENS WITHIN A MINE

CROSS-REFERENCE TO RELATED APPLICATIONS

This application claims priority to provisional application 61/032,120 that was filed on Feb. 28, 2008.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention generally relates to apparatus and methods for providing breathable air to one or more safe havens within an underground mine from a source external to the mine.

2. General Background of the Invention

In the field of underground mining, the mineworkers, or miners, are always at risk of death from asphyxiation in any type of incident that interrupts the flow of breathable air into the mine and prevents them from exiting the mine before the breathable air in the mine is consumed. Under current regulations, each miner is required to carry one or more self-contained breathing apparatuses or self-contained self-rescuers (SCSRs). Under current regulations, the SCSRs carried by a miner are supposed to provide a sufficient supply of breathable air to either allow the miner to exit the mine or to make it to a safe haven within the mine. Safe havens are required whenever the working face of the mine is more than a specified number of feet from the mine entrance. Multiple safe havens become required when the mine face is located still farther away from the mine entrance.

Under current MSHA regulations, a safe haven must be capable of providing no less than 96 hours of breathable air for the number of miners expected to take shelter in the case of an emergency. This is intended to provide an adequate amount of time for the miners to be rescued. Generally breathable air is supplied by oxygen candles, bottled oxygen, bottled compressed air, or some other type of finite supply. Such finite supplies are far from ideal, however, because 96 hours does not always provide a sufficient amount of time. In many cases if it takes just a few short hours more than 96 for rescuers to reach the trapped miners, the miners in the safe haven will die. Bottles also present a problem in that they are bulky and take up a great deal of space. They must also be rotated and maintained to ensure they are properly charged and that their valves are operative.

Another problem created by these solutions is that it is not practical to provide enough breathable air to maintain a positive pressure inside the safe haven. Thus, it becomes necessary to make the safe haven airtight. Once this is done, then dealing with accumulated $CO_2$ and CO become as problematic as providing breathable air in the first place. Typical solutions involve the use of various devices that absorb $CO_2$ and CO, but once the absorption capacity of these devices is exceeded, these poisonous gases can quickly reach toxic concentrations in the atmosphere inside the safe haven. Maintenance of these $CO_2$ and CO absorbing devices is also problematic because many of them have a shelf life and must be replaced periodically.

Having to create an airtight safe haven also presents a problem from the standpoint of what must be done if a miner arrives at the safe haven after it has been established and purged. If the miner is allowed to enter, the atmosphere in the safe haven will generally have to be purged again, consuming a great deal of the limited supply of breathable air, which could greatly reduce the amount of time that a breathable atmosphere can be maintained in the safe haven.

Yet another problem that can occur in a disaster is the unwanted intrusion of water in or around the safe haven, in between the safe haven and the mine entrance, or in between miners and the safe haven. Having a means of pumping this water out without requiring the pre-location of expensive permissible pumps would be beneficial.

Thus, what is needed is an apparatus and a method for establishing safe havens within a mine that will allow a virtually unlimited supply of breathable air to one or more safe havens in the mine. Said apparatus and method should also be capable of maintaining a positive air pressure relative to the air pressure in the mine within each of the safe havens so as to eliminate the need to scrub $CO_2$ and CO from the atmosphere inside the safe havens.

What is also needed is a means of pumping water from undesirable areas in the mine without the use of costly permissible pumps.

SUMMARY OF THE INVENTION

The present invention relates to apparatus and method for providing breathable air to one or more safe havens in an underground mine from a source external to the mine. More specifically, the invention utilizes a source of compressed, breathable air that is located outside of the underground mine. The breathable air is then made available throughout the mine to allow safe havens to be established where required by MSHA regulations or state regulations or where necessitated by the particular configuration of the mine. The capacity of said external source is sized to accommodate the number of safe havens required for a particular mine, including the capacity to establish and maintain a positive pressure environment within each safe haven.

The present invention additionally provides the capability of using air pressure to pump water from undesirable areas of the mine through the use of air-driven pumps rather than costly, permissible electric pumps.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
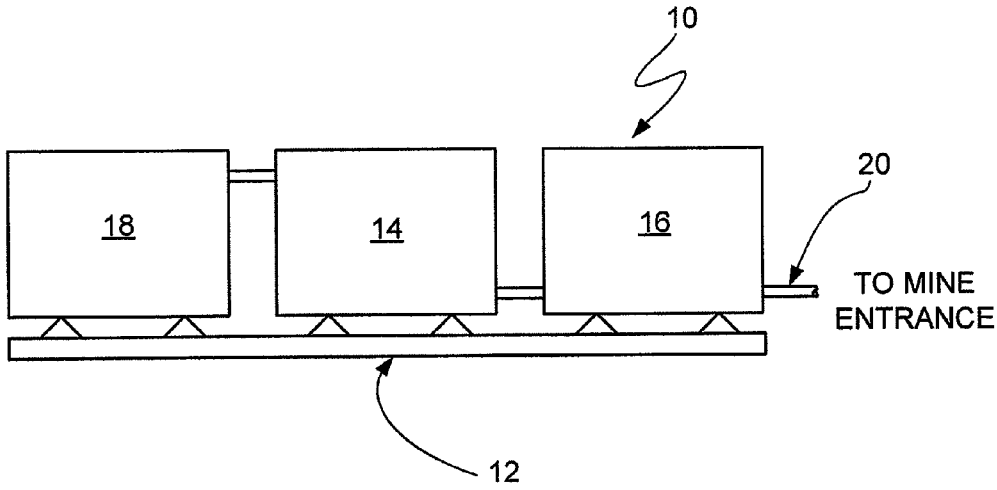
FIG. 1 illustrates an embodiment of the external source of compressed, breathable air.

FIG. 1 shows an embodiment of the external source of compressed, breathable air 10 to be supplied to the mine. External source 10 comprises sled 12 onto which compressor 14, air filter 16, and optional generator 18 are mounted. Compressor 14 can be any commercially available compressor such as the SSR-EP75 Rotary Screw air compressor from Ingersoll Rand. Compressor 14 is preferably sized to provide sufficient air supply in cubic feet per minute and pressure to support the maximum number of miners that may have to be supported in an emergency at the farthest location, pneumatically speaking, from compressor 14. External source 10 preferably includes durable outer shell 11 (not shown) that encloses compressor 14, air filter 16, and generator 18. Still more preferably, each of compressor 14, air filter 16, and generator 18 are enclosed in separate compartments 15, 17, and 19 (not shown) within enclosure 11.

Compressor 14 is electrically connected to the mine installation's primary power source (not shown) and optional generator 18. In one embodiment, the electrical connection of compressor 14 to the mine installation's primary power source and generator 18 will automatically start generator 18 and switch compressor 14 to receive its power from generator 18 upon the occurrence of any incident in which the supply of power from the mine installation's primary power source is interrupted. In an alternate embodiment, compressor 14 is continuously powered by generator 18.

Compressor 14 is in pneumatic connection with filter 16. Filter 16 can be any type of commercially available filter designed to provide breathable air from a compressed air system such as the Model 1916 Catalite filter from Hankison International. Filter 16 is in pneumatic connection with conduit 20 for delivering the breathable, compressed air to safe haven locations 100, 200, 300 in the mine.

In one embodiment, conduit 20 is a two inch diameter, schedule 40 steel pipe with threaded joints. Alternatively, conduit 20 can utilize fitted joints to connect individual sections of pipe. Conduit 20 can alternately be any other diameter that will provide a sufficient volume of air at a sufficient pressure to sustain the necessary number of miners, to purge safe havens 100, 200, 300 within the amount of time required by MSHA or state regulations, and to maintain a positive pressure environment within safe havens 100, 200, 300. Conduit 20 can also be formed of any other material that will withstand the conditions in the mine and be resistant to damage from fire or explosion when installed in the manner of the invention.

Figure 2:
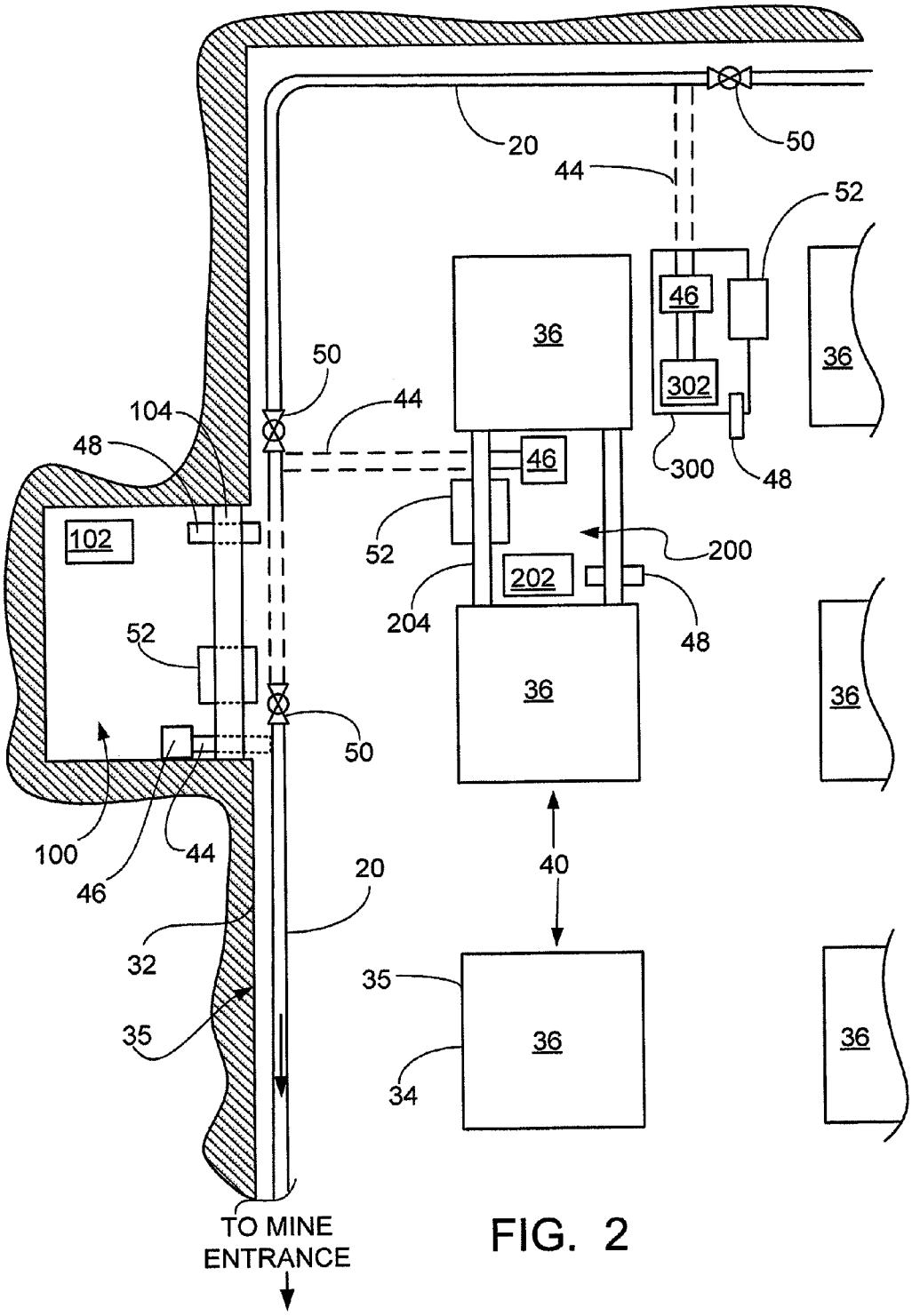
FIG. 2 illustrates the distribution of air from the external source to locations within the mine.
Figure 4:
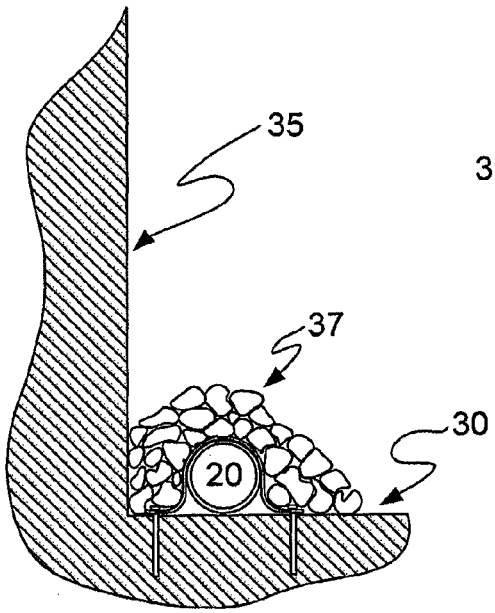
FIG. 4 illustrates an alternative manner of routing an air line though the mine.
Figure 3:
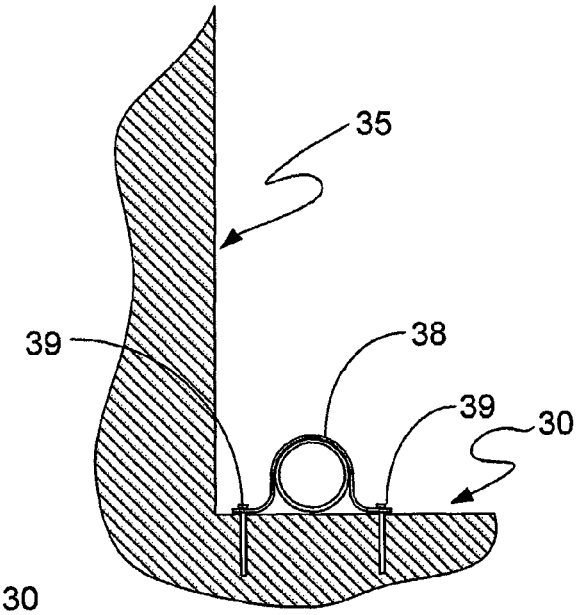
FIG. 3 illustrates a manner of routing an air line though the mine.

Referring now to FIG. 2, the routing of conduit 20 within the mine is illustrated. Conduit 20 runs along floor 30 of the mine. To the extent possible, conduit 20 is located adjacent to solid rib line 32 or pillar rib line 34 that form the peripheries of pillars 36 (collectively referred to as ribs 35 where distinction is not necessary). Referring now to FIG. 3, conduit 20 is anchored to floor 30 using spaced apart mechanical fasteners 38. In one embodiment of the invention, mechanical fasteners 38 are pipe anchors 38 secured to floor 30 using rock anchor bolts 39, although other types of appropriate mechanical fasteners may be used. Where conduit 20 runs adjacent to solid rib line 32 or pillar rib line 34 as illustrated in FIG. 4, conduit 20 is further protected by appropriate ballast material 37, which may be material that has sloughed off of rib 35. In a particular embodiment of the invention, individual pipes having a length of twenty-one feet are connected together to form conduit 20 using a threaded connection on the end of each pipe with conduit 20 anchored to floor 30 at least at each threaded connection.

Figure 5:
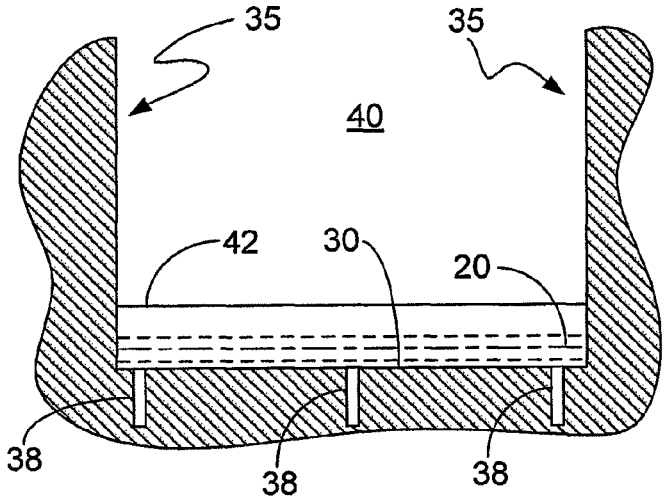
FIG. 5 illustrates a manner of traversing an entry or tunnel intersection with the air line.

Referring now to FIG. 5, where conduit 20 must traverse passage 40, conduit 20 is anchored to floor 30 across the width of passage 40 using mechanical fasteners 38. In an embodiment of the invention, conduit 20 is secured to floor 30 with mechanical fasteners 38 at least near ribs 35 forming the sidewalls of passage 40 and in the center of passage 40. Conduit 20 is further protected across the width of passage 40 with concrete 42. In an embodiment of the invention, concrete 42 has a thickness of at least six inches covering conduit 20.

Referring again to FIG. 2, breathable air is supplied to safe havens throughout the mine via pipes 44 that are connected to conduit 20. In FIG. 2, three types of safe havens are illustrated. Safe haven 100 is located in a blind entry or gobeye. Safe haven 200 is located in a crosscut between two pillars 36. Safe haven 300 is a portable, pre-constructed safe haven. At each safe haven location, there will be provided a cache of emergency supplies 102, 202, 302 containing items necessary to sustain miners in the case of an emergency for at least the amount of time required by MSHA or other regulation (currently this amount of time is 96 hours). Safe havens 100, 200 may be pre-constructed or the materials necessary for constructing the barricades 104, 204, and 206 may be provided at the safe haven location. Such barricades would be constructed in the manner in which such barricades are typically constructed. Alternatively, a portable, pre-constructed safe haven 300 may be provided at an appropriate location and provided with breathable air via pipe 44 that is connected to conduit 20.

Regardless of which type of safe haven is used, pipe 44 terminates in flow regulator 46, which is located within the safe haven, that controls the flow of air into the safe haven. Flow regulator 46 is provided with specific settings for initially purging the safe haven of non-breathable air and for maintaining a constant flow of breathable air. Flow regulator 46 may be any type of commercially available regulator such as the model SSB-11 flowmeter from Dwyer.

Safe havens 100, 200, and 300 are also provided with exhaust regulator 48 that allows non-breathable air to be released from the safe haven. In the case of safe haven 100 that is located in a blind tunnel, exhaust regulator 48 is located in the same barricade wall through which pipe 40 enters safe haven 100. In the case of safe haven 200, exhaust regulator 48 is located in barricade 206, which forms the opposite end of safe haven 200 from barricade 204 through which pipe 44 introduces breathable air into safe haven 200. Alternatively, exhaust regulator 48 could be located in barricade 204. In the case of safe haven 300, exhaust regulator 48 is illustrated as being located at the end of safe haven 300 opposite the end through which pipe 44 introduces breathable air into safe haven 300. Alternatively, exhaust regulator 48 could be located in any other side, including the top and the bottom, of safe haven 300. Exhaust regulator 48 can be any type of device that allows gas to pass through in a single direction only as the result of higher pressure being applied to the side of the regulator located within the safe haven. In one embodiment of the invention, exhaust regulator 48 is a one-way valve such as a mechanical damper available from Orgill.

Each of safe havens 100, 200, 300 is also equipped with airlock 52 to allow additional miners to enter the safe haven without contaminating the atmosphere inside the safe haven.

Immediately following the connection of each pipe 44 to conduit 20, conduit 20 is equipped with shutoff valve 50. This will permit miners utilizing a particular safe haven to isolate the safe haven from a portion of conduit 20 that may be damaged at an inby point relative to the safe haven to allow proper operation of any safe haven located outby relative to the point of damage to conduit 20.

Each safe haven may also be equipped with air-driven pump 80 and tubing 82 or hosing 84 (these items are not shown) to allow undesirable water to be pumped out of the mine or to a more desirable location within the mine. Pump 80 are driven with air supplied via conduit 20 with conduit 20 having taps 86 (not shown) to facilitate the connection of pump 80. Alternatively, one or more pumps 80 and tubing 82 or hosing 84 can be located in any appropriate location within the mine.

While the above describes the illustrated embodiment, those skilled in the art may appreciate that certain modifications may be made to the apparatus and methodology herein disclosed, without departing from the scope and spirit of the invention. Thus, it should be understood that the invention may be adapted to numerous rearrangements, modifications, and alterations and that all such are intended to be within the scope of the appended claims.

I claim:

1. An apparatus for providing breathable air to one or more safe havens within a mine comprising:

an air source located external to the mine including a movable skid, a generator, an air compressor, said air compressor being electrically connected to the generator and a primary source of power for the mine such that electrical power for the air compressor is received from the generator upon interruption of the electrical power from the primary source, and an air filter in pneumatic connection with the air compressor wherein the generator, air compressor, and the air filter are affixed to the movable skid;

a conduit in pneumatic connection with the air filter, said conduit extending from said air filter into said mine and being located on a floor portion of the mine wherein said conduit comprises discrete lengths of metal tubing connected end-to-end;

said conduit is generally located adjacent to a bottom portion of one or more rib walls and anchored to said floor portion using a plurality of pipe straps and rock anchor bolts;

said conduit being further protected by a layer of slough from said one or more rib walls where said conduit is located adjacent to a rib wall and a layer of concrete where said conduit crosses a passage;

a pipe extending from each of said one or more safe havens to the conduit, the pipe being pneumatically connected between the conduit and a flow regulator within the safe haven for controlling the flow of compressed air into the safe haven;

an exhaust regulator located within each of said one or more safe havens for allowing carbon dioxide and other undesirable gases to be exhausted from the safe haven while maintaining positive pressure within the safe haven.

* * * * *